United States Patent [19]

Bosschaert

[11] 4,425,900

[45] Jan. 17, 1984

[54] METHOD AND APPARATUS FOR BRUTING PRECIOUS OR SEMI-PRECIOUS STONES

[75] Inventor: Hendrik Bosschaert, Edegem, Belgium

[73] Assignee: Wetenschappelijk en Technisch Onderzoekscentrum voor Diamant, Antwerp, Belgium

[21] Appl. No.: 296,552

[22] Filed: Aug. 26, 1981

[30] Foreign Application Priority Data

Aug. 18, 1980 [GB] United Kingdom ..... 8026893

[51] Int. Cl.[3] ..... B28D 5/00

[52] U.S. Cl. ..... 125/30 R

[58] Field of Search ..... 125/30 R

[56] References Cited

U.S. PATENT DOCUMENTS 1,105,356 7/1914 Ludlow ..... 125/30 R
2,332,574 10/1943 Hopp ..... 125/30 R
3,202,147 8/1965 Roos ..... 125/30 R
3,568,368 3/1971 Guireman ..... 125/30 R

*Primary Examiner*—Harold D. Whitehead
*Attorney, Agent, or Firm*—Edward J. Brenner

[57] ABSTRACT

A method of bruting two precious or semi-precious stones which includes mounting the stones on respective first and second rotating shafts whose axes lie in substantially parallel planes but which intersect in the region of the stones when viewed in projection perpendicular to said planes, the girdle surfaces of the stones making grinding contact, one of the shafts being substantially translated relative to the other in its plane such that the reference point of its stone travels along a path in the plane which reaches substantially all points within a parallelogram defined by pairs of lines parallel to the respective shafts, the length of the respective sides of the parallelogram being equal to the height of the girdles of the respective stones and the center of the parallelogram lying over the reference point of the other stone when viewed in such projection.

8 Claims, 10 Drawing Figures

METHOD AND APPARATUS FOR BRUTING PRECIOUS OR SEMI-PRECIOUS STONES

Figure 1:
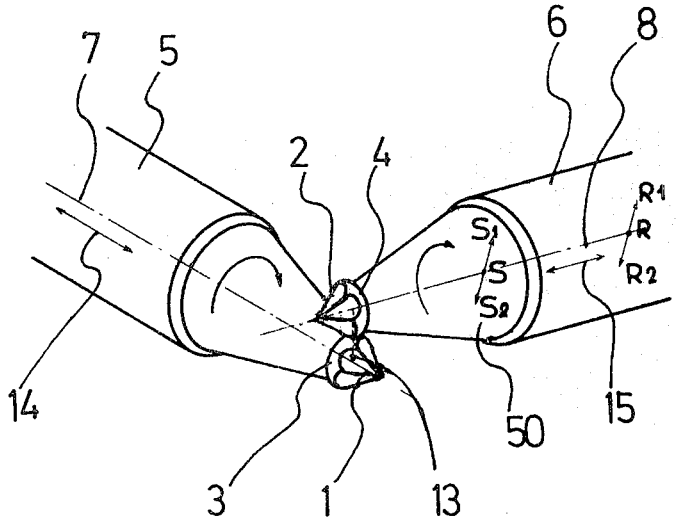

This invention relates to the bruting of precious or semi-precious stones, for example diamonds. Bruting is the operation in which a rough stone, or a half-stone after cleaving or sawing the rough stone, is ground into a circular outline for shaping what is called the girdle of the stone which separates the top side from the bottom side, in preparation to the further grinding of the facets on both sides. For obtaining the conventional brilliant cut, the girdle is completely circular, but for more specific forms, such as the pear-shaped brilliant cut, the girdle comprises a number of arcs of a circle. Although the following description relates to a completely circular girdle, it is to be understood that girdle parts in the form of the arc of a circle can also be ground, using the same principles. Reference will be made hereinafter to a diamond, but it is understood that the invention relates to precious stones in general.

In conventional methods, the diamond to be bruted is, e.g. cemented into a dop, which is mounted for rotation in a bruting machine around an axis coinciding with the axis of the round girdle which is to be formed. Another diamond, as the cutting tool, is cemented or clamped at the end of a stick, which the bruter holds under his arm whilst applying the diamond at the end of it to the rotating diamond in the bruting machine. This method does however not guarantee a perfect cylindrical form of the girdle, which generally is somewhat barrel-shaped. As the bruted shape is the starting shape for grinding the facets, it is important that the girdle be as perfectly cylindrical as possible, because this determines the possibility of obtaining a perfect geometry of the facets.

It has been tried to replace this semi-manual operation by a machine operation in which two diamonds are mounted for rotation on respective shafts whose axes are parallel to each other, both shafts being moved back and forth in the direction of their axes, with respect to each other. In this way both diamonds were caused to brute each other to form a cylindrical girdle. But during bruting, the contact between both stones, as their outlines become cylindrical, evolves into a line contact which needs great forces for bruting and this increases the danger of cracking or rupture of the stones. For this reason this line contact has been avoided by orienting the shafts in crossing relationship with each other, i.e. non-parallel and non-intersecting axes, and giving one of the shafts a movement with respect to the other one, in a plane which is parallel to both axes. This was done, more specifically, by giving one of the shafts a back-and-forth translation movement along a straight line in a direction which has a non-zero component in each of the directions of the shafts. In this way, both cylinders is formation made only a point contact for grinding each other, and this point contact travelled back and forth over the whole height of each cylinder. But the girdle shapes obtained were somewhat conical.

In general terms, irrespective of whether the ground girdle surface is a complete circle or an arc of a circle, it is an object to provide a process in which two precious stones are grinding a girdle surface to each other, the first, and second stones being mounted on a respective rotating shafts, both axes crossing each other and both girdle surfaces making contact for grinding each other, in which the second shaft is substantially translated relative to the first in a plane which is parallel with both axes, which process produces girdle surfaces of more cylindrical form. By "rotary" we mean to include also a part-rotation or reciprocating pivotal movement of the shaft about its longitudinal axis. By referring to a "substantial" translation movement is meant, that the superposition to this movement of a small rotational movement of the second shaft in the said plane for certain reasons is not excluded, in so far as the principles of the invention herebelow are used, and in so far as it is avoided that the two shafts come into parallelism with each other and the girdle surfaces come into a line contact with each other. It is also clear that the necessary slow feeding movement, perpendicular to said plane, in which the distance between both shafts is slowly reduced, is to be superposed on said substantial translation movement.

For the understanding of the terminology further used herein, a "reference point" is considered in each of both stones. This is the centre of the circle, or circle arc, according as the ground girdle surface is a closed cylinder or only a part thereof, obtained by the cross-section of the girdle surface with a plane, perpendicular to the axis of the cylinder and taken at mid-height of the cylinder.

According to the invention there is provided a method of bruting two precious or semi-precious stones including mounting said stones on respective first and second rotating shafts whose axes lie in substantially parallel planes but which intersect in the region of said stones when viewed in projection perpendicular to said planes, the girdle surfaces of said stones making grinding contact, one of said shafts being substantially translated relative to the other in its said plane such that the reference point of its stone as herein defined travels along a path in said plane which reaches substantially all points within a parallelogram defined by pairs of lines parallel to the respective shafts, the length of the respective sides of the parallelogram being equal to the height of the girdles of respective stones and the centre of the parallelogram lying over the reference point of the other stone when viewed in said projection.

Preferably, said relative translation is effected by axial translation of each shaft back and forth.

Viewed from another aspect the invention provides apparatus for carrying out the method set forth above comprising first and second rotatable shafts whose axes lie in substantially parallel planes but which intersect in the region of adjacent ends of the shafts when viewed in projection perpendicular to said planes, means for mounting respective precious or semi-precious stones to the adjacent ends of said shafts such that the girdle surfaces of said stones make grinding contact, and means for substantially translating one of said shafts relative to the other in its said plane such that the reference point of its stone as herein defined travels along a path in said plane which reaches substantially all points within a parallelogram defined by pairs of lines parallel to the respective shafts, the four corners of which parallelogram are defined by the four extreme positions of the reference point corresponding to the four combinations in which the second shaft is in respective extreme positions in the direction of the first shaft, and in respective extreme positions in the direction of the second shaft.

Thus the movement is of a sort in which a reference point on the axis of the second shaft describes a figure which reaches substantially each point in the parallelogram of which the four corners are the four extreme positions of said reference point, corresponding to the four combinations in which the second shaft is in one of both extreme positions in the direction of the first shaft, and in one of both extreme positions in the direction of the second shaft.

Preferably, said shafts are mounted on respective frames, each of which is movable back and forth in the direction of the axis of the respective shaft.

Figure 4:
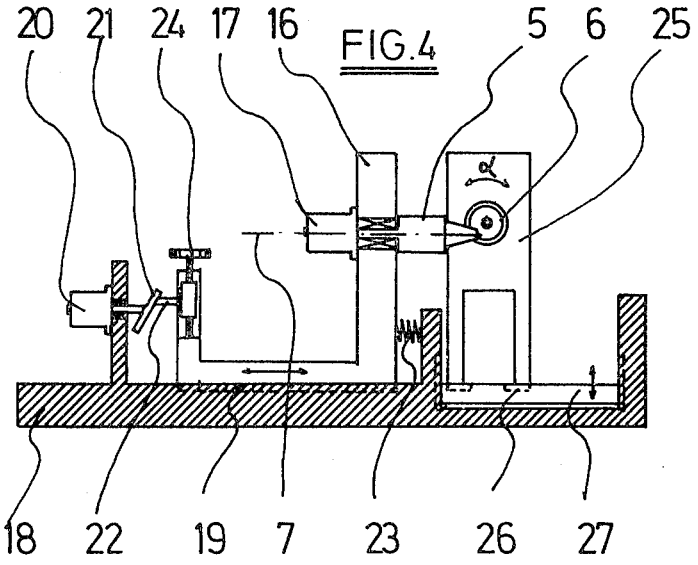
Figure 5:
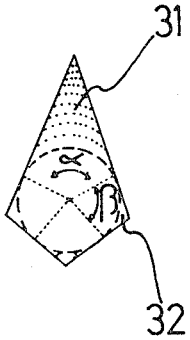
Figure 6:
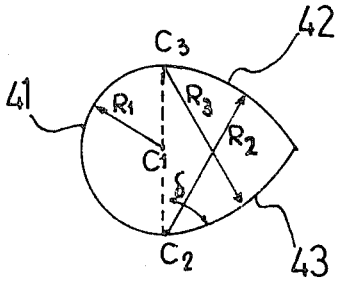

In order that the invention may be readily understood, certain embodiments thereof will now be described with reference to the accompanying drawings in which:

FIG. 1 is a view of two diamonds mounted on their respective shafts,

FIG. *2a* is a side projection and FIG. *2b* a top projection showing the relative position of both diamonds when mounted on the shafts, FIGS. *3a–d* show a number of possible figures which can be described by the reference point of the second stone, FIG. 4 is a schematic view of an apparatus for carrying out the method of the invention, FIG. 5 shows a cross-sectional view of a rough stone mounted on the shaft at the start of the operation, the cross-section being taken perpendicularly to the axis of the shaft in a plane where the girdle is to be bruted, and FIG. 6 shows a pear-shaped girdle which can also be made by the present process.

In FIG. 1 are shown two precious stones 1 and 2 each having the form of a half octahedron pyramid, of which the outlines are ground to a circular form, producing girdles 3 and 4. Each stone is fixed on respective shaft 5, 6, by cementing each of them in a dop, and mounting the dop at the end of the corresponding shaft 5,6, in the same way as the rotating diamond is fixed on the shaft of a conventional bruting machine. The shafts 5,6 cross each other and having their ends approximately at the intersection point of the axes 7,8 with the common perpendicular 13 on both axes, in such a way that both diamonds can brutingly contact each other.

In the prior art shaft 5 is rotated about axis 7 and shaft 6 around axis 8, in such a way that both diamonds 1 and 2 grind each other. Whilst keeping shaft 5 fixed, apart from its rotation around axis 7, the shaft 6 is given a small translation movement, parallel with itself, in a plane which is parallel with axes 7 and 8, e.g. so that points R and S on axis 8 move back and forth in that plane according to line $R_1$ $R_2$ or $S_1$ $S_2$. The diamonds are supposed to grind cylindrical girdles on each other, but experience proves they do not.

Figure 2A:
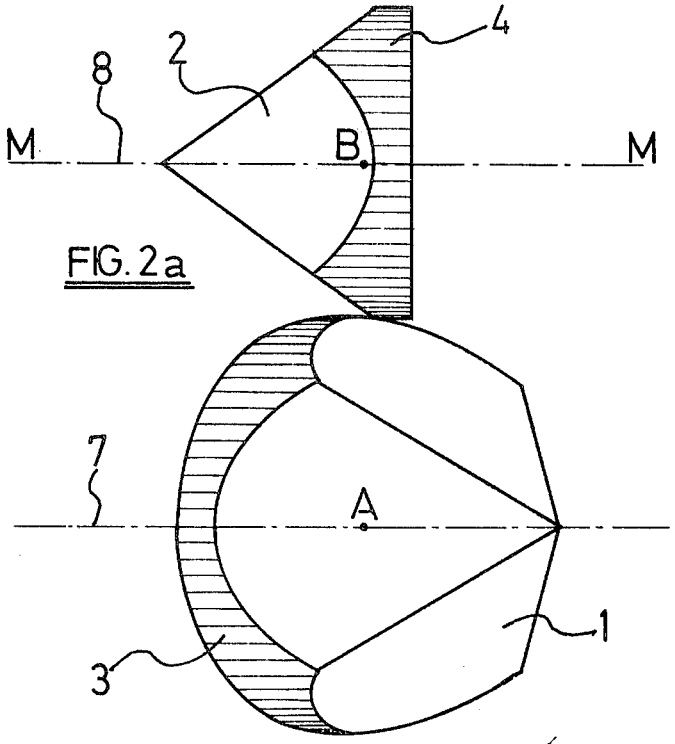
Figure 2B:
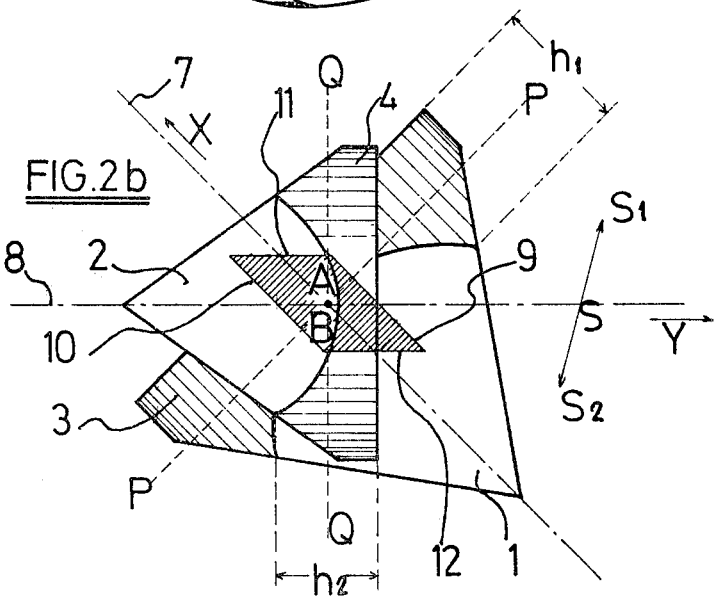

FIG. 2 shows in more detail the relative positions of both stones 1 and 2, FIG. *2a* in side view, FIG. *2b* in top view. The parts outside the girdle radius are already ground off, over a height $h_1$ for stone 1 and height $h_2$ for stone 2, the heights being measured in the direction of the respective axes of rotation 7,8, and this height $h_1$, $h_2$ is what is called the height of the girdles 3, 4. At mid-height of the girdle, measured in the direction of the corresponding axis of rotation, i.e. in a plane P P, or Q Q, perpendicular to the axes 7,8, respectively on FIG. *2b*, the cross-section of such plane with the corresponding cylinder on which the girdle surface 3,4, lies, is a circle which the centre A, respectively B is called hereinafter the "reference-point" of the stones 1, 2. These reference-points lie on the corresponding axis of rotation 7, 8. The relative position, at the moment that FIG. 2 is taken, is such that the reference-point B of stone 2 is located exactly perpendicularly above reference-point A of stone 1, so that both points coincide on the vertical projection of FIG. *2b*.

When both shafts maintain the same relative position with respect to each other as shown in FIG. 1, the girdles make a point contact with each other at mid-height of each girdle, and in each girdle only the circle at mid-height is ground. In order to reach all circles on both girdles, it is necessary that the shaft with axis 8 is moved with respect to the shaft with axis 7. And this shaft with axis 8 is given a translation movement, parallel with itself, in the plane M M (FIG. *2a*) which is parallel with axes 7 and 8, e.g. so that reference point S of shaft 6 (FIGS. 1 and *2b*) moves back and forth along line $S_1$ $S_2$. As the relative movement of shaft 6 with respect to shaft 5 is considered, shaft 5 is kept stationary, apart from its rotation.

In general, a translation is given to shaft 6 having axis 8, and the reference-point B of stone 2 will describe a Figure F in the plane M M whilst the projection of reference-point A of stone 1 remains stationary. When considering in plane M M (FIG. *2b*) an abscissa-axis x parallel with axis 7 through the projection of point A on plane M M, and an ordinate-axis y, coinciding with axis 8, it will be necessary, in order to reach all circles of girdle 3, that the reference-point B of stone 2, when describing its Figure F, reaches all abscisses between $-\frac{1}{2}h$, and $+\frac{1}{2}h_1$. And, in order that the grinding contact point would reach all circles of girdle 4, it will be necessary that the reference-point B reaches all ordinates between $-\frac{1}{2}h_2$ and $+\frac{1}{2}h_2$. But this is not sufficient for obtaining sufficiently perfect cylindrical girdle surfaces.

Different figures F can come into consideration, e.g. a back-and-forth movement $F_1$ between two extremities $B_1$ and $B_2$ (FIG. *3a*) or $B'_1$ and $B'_2$. In both cases, all the circles of girdles 3 and 4 are reached, because B reaches all obscissas between $-\frac{1}{2}h_1$ and $+\frac{1}{2}h_1$ and all ordinates between $-\frac{1}{2}h_2$ and $+\frac{1}{2}h_2$. The same applies to the figure F, corresponding to a parallelogram movement $B''_1$ $B''_2$ $B''_3$ $B''_4$ (FIG. *3b*). But in both cases, revolution shapes are obtained for the girdles, which are not sufficiently perfect cylinders.

The foregoing description relates to the prior art. An embodiment of the invention will now be described.

It is a premise of the invention that it is not sufficient that a figure F is described in which all abscissas between $-\frac{1}{2}h_1$ and $+\frac{1}{2}h_1$, and all ordinates between $-\frac{1}{2}h_2$ and $+\frac{1}{2}h_2$ are reached, but that it is necessary that all points are reached inside the parallelogram determined by $-\frac{1}{2}h_1 \leqq x \leqq +\frac{1}{2}h_1$ and $-\frac{1}{2}h_2 \leqq y \leqq +\frac{1}{2}h_2$. This is the hatched parallelogram, shown in FIG. *2b*, determined by two lines 9 and 10 which are parallel with axis 7 and have as length $h_1$, and by two lines 11 and 12 which are parallel with axis 8 and have as length $h_2$, where the centre of the parallelogram (i.e. the intersection point of both diagonals) coincides with the projection of the reference-point A of stone 1 on plane M M.

Describing a figure in which all points inside the parallelogram are reached can, abstractly and mathematically speaking, be obtained e.g. by a movement in which the abscis of B follows a periodic movement between $-\frac{1}{2}h_1$ and $+\frac{1}{2}h_1$ with a cycle period $T_1$ and the ordinate a periodic movement between $-\frac{1}{2}h_2$ and $+\frac{1}{2}h_2$ with a cycle period $T_2$, in which $T_1$ and $T_2$ are not measurable with a same measure unity (such as 2 and $\pi$, 2 and e). A part of such figure F is shown in FIG. *3c*. As the periods $T_1$ and $T_2$ are not measurable with a same unity, the Figure F will never close on itself and continue indefinitely to reach new points in the parallelogram, so that, abstractly speaking, all points are reached.

Figure 3A:
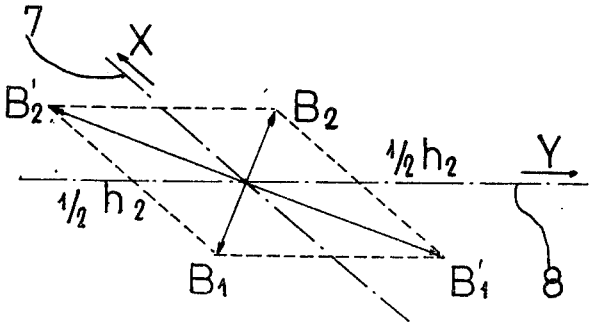
Figure 3B:
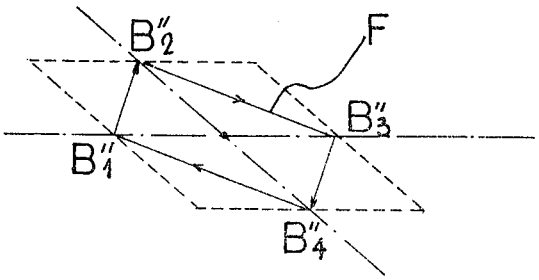
Figure 3C:
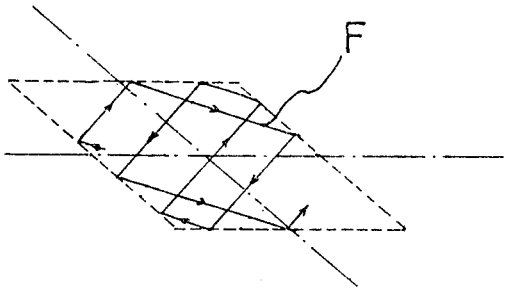
Figure 3D:
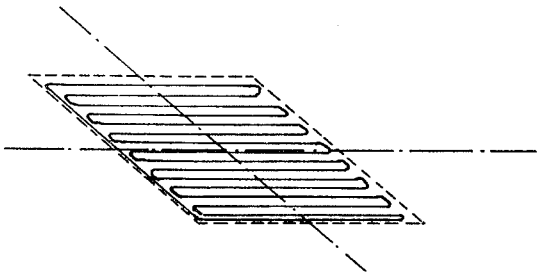

Practically speaking, it is not possible that all points, in a mathematically abstract sense, of the parallelogram are reached. Thus when we refer to all points in the parallelogram we mean that it is sufficient that the obtained Figure F reaches each point of the parallelogram to a distance which is not greater than a certain maximum d, and the smaller d, the more accurate the cylinder is. A maximum d which is at the most one tenth of the longer side of the parallelogram, preferably not more than 0.05 mm is still tolerated, although it is preferable that this maximum be not greater than 0.02 mm. In fact, it is a question to avoid any functional relationship between the abscissa and the ordinate of the movement, which would result in a Figure F which closes too rapidly on itself before having passed sufficiently near to each point of the parallelogram, such as the linear relationships shown on FIGS. 3*a* and 3*b*. A zigzag movement according to FIG. 3*d* however can e.g. produce an allowable figure F, in so far as the distance between the zigzag lines is not more than said maximum distance d.

As shown in FIG. 1, the first diamond 1 is mounted on shaft 5 and the second diamond 2 on shaft 6. The required relative movement of both shafts with respect to each other can be obtained, e.g. by holding shaft 5 at rest with respect to the fixed frame of the grinding apparatus, apart from its rotation around axis 7, and by giving shaft 6 the required movement, with respect to the fixed frame of the grinding apparatus. Another, and preferred, possibility is to move shaft 5, parallel to itself, back and forth along its axis 7, as shown by the arrows 14, with respect to the fixed frame, and to do the same with shaft 6, i.e. to move this shaft 6, in parallel with itself, back and forth along its axis 8, as shown by the arrows 15, with respect to the same fixed frame. The cyclic periods of both movements are then chosen not to have any relationship with each other so that the Figure F, as determined above, would not close too rapidly on itself in the sense explained above. The frequencies of both movements are therefore preferably incommensurable, i.e. not divisible by a same number such as e.g. 23 and 60 cycles per minute.

An example of this preferred possibility, is schematically given on FIG. 4 which shows the shaft 5 perpendicular to shaft 6 (the said parallelogram is then a rectangle). Shaft 5 is mounted for rotation in a piece 16 which comprises the driving motor 17 for rotation of this shaft, and which is slidable, in the direction parallel with axis 7 of this shaft, with respect to the fixed frame 18, in which it is guided by a pair of rails 19 (only one shown). A second driving motor 20 is mounted on framed 18, which ends on an inclined rotating disc 21 which makes contact with a pin 22 which forms part of the sliding piece 16 and is pressed against the disc 21 by means of spring 23. Rotation of disc 21 causes, in a known way, a back and forth movement of the sliding piece 16 and of rotating shaft 5 with respect to the fixed frame, along its axis 7. The amplitude of this movement is adjustable by screw 24 which adjusts the radial position of pin 33, with respect to the centre of the disc 21. A similar arrangement is made for shaft 6, but the slidable piece 25 in which this shaft is mounted, is slidable along rails 26, analogous with rails 19, in a table 27 which is vertically slidable, i.e. in a direction perpendicular to both shafts 5 and 6, in the fixed frame 18 for producing the feeding movement in which both diamonds are brought nearer to each other for further grinding according to smaller circles. This feeding movement is given by a rotating screw (not shown) which traverses table 27 perpendicularly through an opening in which it engages with the screw thread in that opening, although other ways of producing that movement are equally possible.

In most cases the rough stone presents at the start a cross-sectional shape which is far from circular (FIG. 5) and firstly it is mounted on shaft 6 (FIG. 4) for relatively slow oscillation, not rotation, back and forth over an angle $\alpha$, corresponding with angle $\alpha$ on FIG. 5, for firstly grinding off the protruding part 31. (When starting to grind off the tip of part 31, the oscillation angle can be very small, and the angle $\alpha$ increases according as the grinding goes deeper.) Then the protruding part 32 is ground off by oscillation of shaft 6 over an angle $\beta$, and so on until the cross-sectional shape is almost circular. The stone which is mounted on shaft 5 for grinding off those protruding parts, rotates at comparatively high speed as a grinding tool, is a stone which has already been shaped into nearly a circle in a similar operation before, and which is now further ground off to its final girdle dimension. This means that, whilst shaft 5 is made to rotate by motor 17 (FIG. 4) at a certain speed of rotation, the corresponding driving motor (not shown on FIG. 4) of shaft 6 is a motor which is in general required to produce an oscillating movement, over a certain amplitude angle $\alpha$, about the axis of shaft 6. For that reason, a reversible step motor is used for driving shaft 6. Such step motor makes a rotation step in answer to each electrical impulses that it receives, in one or in the other sense according as it is switched for rotation in one or other sense. By making the sense of rotation each time to switch over after an adjustable number of pulses, the amplitude angle $\alpha$ of the oscillation is made adjustable, whilst the speed of rotation is adjustable by adjusting the frequency of the impulses.

As an example, a step-motor was used for shaft 6, producing steps of 0.3°, and arranged for receiving pulses at an adjustable frequency from 0 to 180 pulses per second, and of which the frequency was held at 120 pulses per second. Shaft 5 was driven by a direct current motor of 80 watt which the speed was adjustable between 0 and 6000 revolutions per minute, and held at 2400 r.p.m. The motor 20, and its corresponding motor for the back and forth movement of shaft 6, were independently from each other continuously adjustable in speed and held at a speed of 23, respectively 60 revolutions per minute. In this way it takes a time in the order of 10 to 20 minutes to brute a rough diamond stone of a dimension corresponding with a circular girdle in the order of 5 millimeter diameter.

Also non-circular girdle shapes can be made by the present method in so far as the shape of the girdle comprises a number of circle arcs, e.g. the pear-shape of FIG. 6. This girdle comprises three cylindrical girdle surfaces 41, 42, 43, having a centre and radius respectively $C_1$ and $R_1$, $C_2$ and $R_2$, $C_3$ and $R_3$ ($R_2$ being equal to $R_3$). The stone is mounted on the shaft 6 in such a way that $C_2$ coincides with the axis of rotation of shaft 6, and the shaft is made to oscillate back and forth over the angle $\delta$, whilst a stone, which is mounted on shaft 7, grinds the shape 42. Subsequently and in an analogous way, the contiguous shapes 41 and 43 are also ground for forming the complete girdle.

As shown in FIG. 1, the stones 2 and 3 are mounted at the end extremity of the corresponding shaft 5 and 6, and they should be well centered. This means that what is intended to become the axis of symmetry of the stone, must coincide as accurately as possible with the axis of rotation of the corresponding shaft. For that reason, the stone is preferably cemented on a dop 50 (FIG. 1) which is a piece having a substantially cylindrical symmetry around an axis, and which is mounted on the extremity of the shaft with that axis coinciding with the axis of rotation of the shaft. This dop can e.g. be provided with a platform in a plane perpendicular to the axis of the dop and on which the stone is cemented. This platform is then made movable in two directions in its own plane by means of adjusting screws. After centering, the dop with the stone thereon is then mounted on the shaft.

There is no special limitation to the form of what is called "shaft" here, in so far as it is rotatable around an axis and permits a diamond or other precious stone to be mounted thereon for being bruted. The movement of the axis of rotation of one shaft with respect to the other one must not necessarily be a perfect translation of that axis in perfect parallellism with itself. The superposition of a small rotation in the same plane of the translation is also allowable, in so far as the principle of the invention is still used, mutatis mutandis, namely that the sides of the parallelogram will no longer be strictly straight but slightly deformed into arcs of a circle, but still all points of this "parallelogram" must be reached in substance.

I claim:

1. A method of bruting two precious or semi-precious stones including mounting said stones on respective first and second rotating shafts whose axes lie in substantially parallel planes but which intersect in the region of said stones when viewed in projection perpendicular to said planes, the girdle surfaces of said stones making grinding contact, one of said shafts being substantially translated relative to the other in its said plane such that the reference point of its stone as herein defined travels along a path in said plane which reaches substantially all points within a parallelogram defined by pairs of lines parallel to the respective shafts, the length of the respective sides of the parallelogram being equal to the height of the girdles of respective stones and the centre of the parallelogram lying over the reference point of the other stone when viewed in said projection.

2. A method according to claim 1 in which the rotation of one of said shafts is continuous whereby to obtain a circular girdle on the stone mounted thereon.

3. A method according to claim 1 in which the rotation of one of said shafts is back and forth defining a maximum angle whereby to obtain a girdle on the stone mounted thereon which is an arc of a circle.

4. A method according to claim 3 including forming one or more further said arcs to form a non-circular closed girdle.

5. A method according to claim 3 in which one of said arcs is formed at the location of the initial protrusions of the rough stone.

6. A method according to claim 1 including effecting said relative translation by axial translation of each said shaft back and forth.

7. Apparatus for carrying out the bruting of two precious or semi-precious stones comprising first and second rotatable shafts whose axes lie in substantially parallel planes but which intersect in the region of adjacent ends of the shafts when viewed in projection perpendicular to said planes, means for mounting respective precious or semi-precious stones to the adjacent ends of said shafts such that the girdle surfaces of said stones make grinding contact, and means for substantially translating one of said shafts relative to the other in its said plane such that the reference point of its stone as herein defined travels along a path in said plane which reaches substantially all points within a parallelogram defined by pairs of lines parallel to the respective shafts, the four corners of which parallelogram are defined by the four entreme positions of the reference point corresponding to the four combinations in which the second shaft is in respective extreme positions in the direction of the first shaft, and in respective extreme positions in the direction of the second shaft.

8. Apparatus according to claim 7 in which said shafts are mounted on respective frames, each of which is movable back and forth in the direction of the axis of the respective shaft.

* * * * *